US011517163B2

(12) United States Patent
Sauer et al.

(10) Patent No.: US 11,517,163 B2
(45) Date of Patent: Dec. 6, 2022

(54) RETAINING PLATE FOR A VACUUM CLEANER FILTER BAG, HAVING A CLOSURE DEVICE

(71) Applicant: Eurofilters Holding N.V., Overpelt (BE)

(72) Inventors: Ralf Sauer, Overpelt (BE); Jan Schultink, Overpelt (BE)

(73) Assignee: EUROFILTERS HOLDING N.V., Overpelt (BE)

( * ) Notice: Subject to any disclaimer, the term of this patent is extended or adjusted under 35 U.S.C. 154(b) by 564 days.

(21) Appl. No.: 16/480,590

(22) PCT Filed: Jan. 29, 2018

(86) PCT No.: PCT/EP2018/052082
§ 371 (c)(1),
(2) Date: Jul. 24, 2019

(87) PCT Pub. No.: WO2018/145937
PCT Pub. Date: Aug. 16, 2018

(65) Prior Publication Data

US 2019/0387938 A1 Dec. 26, 2019

(30) Foreign Application Priority Data

Feb. 7, 2017 (EP) ..... 17155002

(51) Int. Cl.
*A47L 9/14* (2006.01)

(52) U.S. Cl.
CPC ..... *A47L 9/1445* (2013.01)

(58) Field of Classification Search
CPC ..... B01D 46/0005; A47L 9/00; A47L 9/14; A47L 9/1427; A47L 9/1445
(Continued)

(56) References Cited

U.S. PATENT DOCUMENTS 3,383,030 A 5/1968 Downey
3,401,867 A 9/1968 Long et al.
(Continued)

FOREIGN PATENT DOCUMENTS

AU 2017381004 B2 7/2019
CH 483 247 12/1969
(Continued)

OTHER PUBLICATIONS

East Bavarian Technical College: construction course in plastics technology East Bavarian Technical University Amberg-Weiden; Study content for the course of plastics technology; downloaded from the internet on May 23, 2019 at https://www.oth-aw.de/studiengaenge-und-bildunasangbote/studienangebote/bachelor-studiengaenge/kunststofftechnik/aufbau/; 10 pages including English translation.

(Continued)

*Primary Examiner* — Minh Chau T Pham
(74) *Attorney, Agent, or Firm* — Crowell & Moring LLP

(57) ABSTRACT

The present invention relates to a retaining plate 1 for a vacuum cleaner filter bag, including a base plate 2 having a passage opening 3 formed therein and a closure device for closing the passage opening 3, where the closure device includes two closure parts 4, 5 arranged in a plane parallel to the passage opening 3, and where the closure parts 4, 5 are movable relative to each other in the plane, so that, by a closing movement in the plane, they are movable to a closure position at which they close the passage opening 3 by overlapping each a respective part of the passage opening 3.

20 Claims, 4 Drawing Sheets

(58) Field of Classification Search
USPC ..... 55/367, 374, 377, DIG. 2; 15/347, 352
See application file for complete search history.

(56) References Cited

U.S. PATENT DOCUMENTS

| | | | | |
|---|---|---|---|---|
| 5,226,941 | A * | 7/1993 | Uibel | A47L 9/1445 55/377 |
| 5,230,724 | A * | 7/1993 | Marafante | A47L 9/1445 55/377 |
| 5,472,460 | A * | 12/1995 | Schmierer | A47L 9/1427 55/377 |
| 5,472,465 | A * | 12/1995 | Schmierer | A47L 9/1427 55/377 |
| 5,766,283 | A * | 6/1998 | Bumb | A47L 9/1445 55/374 |
| 5,820,643 | A | 10/1998 | Leinenlüke et al. | |
| 6,136,056 | A * | 10/2000 | Krehan | A47L 9/1445 55/377 |
| 7,468,083 | B2 * | 12/2008 | Davis | A47L 9/00 55/377 |
| D600,868 | S | 9/2009 | Rennecker et al. | |
| 7,799,107 | B2 * | 9/2010 | Corney | A47L 9/1445 55/377 |
| 7,815,704 | B2 * | 10/2010 | Schmierer | A47L 9/1427 55/374 |
| 2007/0175817 | A1 | 8/2007 | Goldman | |
| 2007/0214755 | A1 * | 9/2007 | Corney | A47L 9/1445 55/367 |
| 2009/0272083 | A1 | 1/2009 | Sauer et al. | |
| 2009/0223190 | A1 | 9/2009 | Nauta et al. | |
| 2011/0030557 | A1 | 2/2011 | Brownstein et al. | |
| 2019/0208973 | A1 * | 7/2019 | Werius | B01D 46/0005 |

FOREIGN PATENT DOCUMENTS

| | | | |
|---|---|---|---|
| CN | 101431930 | | 5/2009 |
| CN | 101747596 | A | 6/2010 |
| CN | 202730890 | | 2/2013 |
| DE | DT 1 628 582 | | 2/1968 |
| DE | 1301881 | B | 8/1969 |
| DE | 2533590 | A1 | 2/1977 |
| DE | 0202639 | A2 | 11/1986 |
| DE | 8622890 | U1 | 12/1987 |
| DE | 88 11 821 | U1 | 12/1988 |
| DE | 3714780 | A1 | 12/1988 |
| DE | 90 16 893 | U1 | 4/1991 |
| DE | 90 16 939 | U1 | 5/1991 |
| DE | 91 01 981 | U1 | 6/1991 |
| DE | 93 16 626 | U1 | 2/1995 |
| DE | 44 15 350 | A1 | 11/1995 |
| DE | 296 14 272 | U1 | 9/1996 |
| DE | 296 15 163 | U1 | 1/1997 |
| DE | 19806452 | A1 | 8/1999 |
| DE | 200 05 448 | U1 | 6/2000 |
| DE | 2001 0049 | U1 | 10/2000 |
| DE | 199 19 809 | A1 | 11/2000 |
| DE | 199 48 909 | A1 | 4/2001 |
| DE | 102 03 460 | A1 | 8/2002 |
| DE | 102 03 405 | A1 | 8/2003 |
| DE | 10221694 | A1 | 12/2003 |
| DE | 203 16 574 | U1 | 2/2004 |
| DE | 202004008971 | U1 | 8/2004 |
| DE | 20 2008 004 733 | U1 | 11/2005 |
| DE | 10 2005 027 078 | A1 | 1/2007 |
| DE | 10 2005 041 811 | A1 | 3/2007 |
| DE | 20 2006 020 047 | U1 | 10/2007 |
| DE | 10 2006 037 456 | A1 | 2/2008 |
| DE | 10 2006 055 890 | A1 | 5/2008 |
| DE | 20 2008 003 248 | U1 | 6/2008 |
| DE | 20 2008 005 050 | U1 | 7/2008 |
| DE | 10 2008 046 200 | A1 | 4/2009 |
| DE | 10 2007 053 151 | A1 | 5/2009 |
| DE | 10 2007 057 170 | A1 | 5/2009 |
| DE | 10 2007 062 028 | A1 | 6/2009 |
| DE | 20 2008 001 391 | U1 | 7/2009 |
| DE | 202008004025 | U1 | 8/2009 |
| DE | 20 2008 006 904 | U1 | 11/2009 |
| DE | 10 2008 041 227 | A1 | 2/2010 |
| DE | 20 2008 018 054 | U1 | 6/2011 |
| DE | 10 2010 060 175 | A1 | 3/2012 |
| DE | 10 2011 008 117 | A1 | 4/2012 |
| DE | 10 2010 060 353 | A1 | 5/2012 |
| DE | 10 2011 105 384 | A1 | 12/2012 |
| DE | 20 2011 052 208 | U1 | 3/2013 |
| DE | 20 2013 001 096 | U1 | 4/2013 |
| DE | 20 2013 100 862 | U1 | 5/2013 |
| DE | 10 2012 012 999 | A1 | 7/2013 |
| DE | 20 2013 103 508 | U1 | 10/2013 |
| DE | 10 2014 109 596 | A1 | 2/2015 |
| DE | 20 2014 100 563 | U1 | 5/2015 |
| DE | 20 2015 101 218 | U1 | 5/2015 |
| DE | 20 2016 003 890 | U1 | 8/2016 |
| EP | 0 361 240 | A1 | 4/1990 |
| EP | 0 758 209 | A1 | 11/1995 |
| EP | 0 960 645 | A2 | 12/1999 |
| EP | 1 198 280 | A1 | 1/2001 |
| EP | 1 137 360 | A1 | 4/2001 |
| EP | 1 254 693 | A2 | 11/2002 |
| EP | 1258277 | A1 | 11/2002 |
| EP | 1 480 545 | A1 | 9/2003 |
| EP | 1 795 247 | A1 | 6/2007 |
| EP | 1 795 427 | A1 | 6/2007 |
| EP | 1 917 897 | A2 | 5/2008 |
| EP | 1917895 | B1 | 5/2008 |
| EP | 2004303 | B1 | 12/2008 |
| EP | 2 011 556 | A1 | 1/2009 |
| EP | 2 044 874 | A2 | 4/2009 |
| EP | 2 123 206 | A1 | 11/2009 |
| EP | 2 263 508 | A1 | 12/2010 |
| EP | 2 442 703 | A1 | 12/2010 |
| EP | 2 301 404 | A2 | 3/2011 |
| EP | 2 433 695 | A1 | 3/2012 |
| EP | 3 219 373 | A1 | 9/2017 |
| EP | 3 219 374 | A1 | 9/2017 |
| EP | 3 219 375 | A1 | 9/2017 |
| FR | 2 721 188 | A1 | 12/1995 |
| WO | WO 1995/029621 | A1 | 11/1995 |
| WO | WO 01/003802 | A1 | 1/2001 |
| WO | WO 2001/26526 | A1 | 4/2001 |
| WO | WO 2001/078571 | A1 | 10/2001 |
| WO | WO 03/073903 | A1 | 9/2003 |
| WO | WO 07/121979 | A1 | 11/2007 |
| WO | WO 11/047764 | A1 | 4/2011 |
| WO | WO 11/057641 | A1 | 5/2011 |
| WO | WO 13/106392 | A2 | 7/2013 |
| WO | WO 2014/074398 | A2 | 5/2014 |

OTHER PUBLICATIONS

European Standard No. DIN EN 15347: Plastics, Recycled Plastics, Characterisation of Plastics Wastes, English Version; ICS 13.030. 50; 83.080.01; Feb. 2008; 12 pages.

Shen, Li et al.; "Open-loop recycling: A LCA case study of PET bottle-to-fibre recycling," Resources, Conservation and Recycling, vol. 55; Nov. 1, 2010 pp. 34-52.

Lueger; Encyclopedia of the entire technology: Staple Fiber 600 (Neuschappe); downloaded from the Internet on Aug. 29, 2019 at http://www.zeno.org/Lueger-1904/A/Stapelfaser; 1920; including English translation.

Examination Report No. 1 dated Mar. 12, 2021, for Australian Patent Application No. 2019225973 (6 pgs.).

International Search Report dated Apr. 18, 2018 for International Application No. PCT/EP2018/052082.

* cited by examiner

RETAINING PLATE FOR A VACUUM CLEANER FILTER BAG, HAVING A CLOSURE DEVICE

This application claims the benefit under 35 U.S.C. § 371 of International Application No. PCT/EP2018/052082, filed Jan. 29, 2018, which claims the priority of European Patent Application No. 17155002.3, filed Feb. 7, 2017, which are incorporated by reference herein in their entirety.

The present invention relates to a retaining plate for a vacuum cleaner filter bag, comprising a base plate having a passage opening formed therein and a closure device for closing the passage opening.

Such retaining plates are known in a variety of forms for arranging the vacuum cleaner filter bag in a vacuum cleaner housing. The closure device serves in particular to close the passage opening leading into the bag, after use of the bag, so as to prevent an unintentional escape of the sucked-in material. For the closure mechanism, various solutions were proposed, e.g. slide solutions or folding solutions Simple slide solutions are known e.g. from EP 1 284 629 or from DE 10 2006 055 890. Such solutions are, however, disadvantageous insofar as, when seen in the direction of movement of the slide, the retaining plates must be at least twice as large as the passage opening, so that the actual closure element can be moved from an open position, at which the passage opening is not blocked, to a closed position, at which the passage opening is blocked. However, the space available for the retaining plate in the installation space of modern vacuum cleaners is very limited, so that this large dimension in one direction proves to be disadvantageous.

For solving this problem, lamella-type slides have been suggested, e.g. by DE 102 03 405, DE 203 16 574, DE 10 2005 027 078 and EP 1 917 897. These solutions are, however, comparatively expensive to produce. A solution known from DE 20 2008 001 391, in the case of which the closure element is held as a wound roll on the base plate, proves to be just as expensive.

In addition, an automatic slide solution, which cooperates with a corresponding device in the vacuum cleaner housing, is known from EP 0 758 209. However, here too the dimensions of the retaining plate in the direction of sliding are large, so that the solution is not suitable for all vacuum cleaner filter bags and/or vacuum cleaners.

A manual folding solution is known from DE 10 2007 053 151. More complex solutions with an automatic closure mechanism are disclosed by DE 20 2008 018 054, DE 20 2008 006 904, DE 20 2016 003 890 and DE 20 2008 004 733. The latter publication also shows a solution with a multi-part closure element.

Therefore, the known solutions have in common that they are either complex as regards production technology and, consequently, expensive, or that they take up too much space in view of the tight conditions in the installation space of modern vacuum cleaners. In addition, solutions with elastic elements, especially metal springs, are considered to be not environmentally sound.

Hence, it is the object of the present invention to provide a retaining plate, which allows the passage opening of the retaining plate to be closed in a simple and space-saving manner.

This object is achieved by a retaining plate according to claim 1. Advantageous further developments are disclosed in the subclaims.

According to the present invention, the closure device therefore comprises two closure parts arranged in a plane parallel to the passage opening. In this plane, the closure parts are movable relative to each other, so that they are movable to a closure position by a closing movement taking place in the plane. At this closure position, each of the closure parts overlaps with a different part of the passage opening, so that the latter will be blocked and closed in its entirety.

Due to the fact that two closure parts are used, it is not necessary to provide a single closure element having the size of the passage opening. This allows a solution that saves more space. Due to the arrangement of the closure parts in a plane, in which also the closing movement takes place, a technically simple and, consequently, cost-effective solution is possible.

The retaining plate may in particular be configured such that it can be attached to a corresponding retaining unit in a vacuum cleaner housing. Alternatively, the vacuum cleaner filter bag may be adapted to be pushed, with the aid of the retaining plate, over a connection piece on the vacuum cleaner side.

The term retaining plate stands here in particular for a planar component. The dimensions of the retaining plate in two directions perpendicular to each other are therefore many times larger than in a third direction perpendicular to both said directions.

The passage opening of the retaining plate is provided for alignment with an inlet opening of the bag wall, when the retaining plate has been connected to the bag wall of the vacuum cleaner filter bag. Via the passage opening of the retaining plate and the inlet opening of the bag wall, material to be sucked in can be passed into the interior of the vacuum cleaner filter bag, when a vacuum cleaner is in operation.

The base plate may consist of two parallel, spaced-apart components, the closure parts of the closure device being arranged between the components of the base plate. The two components of the base plate can thus reduce or prevent a movability of the closure parts perpendicular to the passage opening. In other words, the closure parts can thus be fixed in a direction perpendicular to the passage opening. The two components of the base plate may be interconnected on at least two sides, in particular two opposed sides. The components of the base plate may be connected, in particular at the connected sides, via a respective hinge, in particular a film hinge, a folding line or a welding seam.

The two closure parts may especially be configured such that, at the closure position, they overlap with different parts of the passage opening. In particular, each of the closure parts may, at the closure position, overlap and thus block one half of the passage opening. Therefore, the two parts will be able to close the whole passage opening. The overlapping of the closure parts with the passage opening should here be understood especially in a view from above, i.e. in a direction of view perpendicular to the passage opening.

The closure device may in particular comprise precisely two closure parts. It is, however, imaginable that the closure parts each comprise a plurality of interconnected elements. In this way, even more compact solutions can be realized. The elements of the closure parts can be interconnected in particular via hinges, especially film hinges.

The statement that the closing movement takes place in the plane of the closure parts should especially be interpreted such that the closing movement of the closure parts does not have a component perpendicular to the plane of the closure parts and thus perpendicular to the passage opening. The statement that the closure parts are movable relative to each other means that a relative movement between the closure parts can take place in the plane. In particular, the closure parts can move towards each other during the closing movement.

The closing movement can transfer the closure parts in particular from an open position to the closure position. At the open position, the passage opening is not overlapped by the closure parts and thus not closed. At the open position, the closure parts may overlap with the base plate, but not with the passage opening.

A possible overlapping always refers to a top view of the retaining plate, i.e. to a direction of view perpendicular to the plane in which the passage opening is arranged.

The closure parts may be interconnected via a connection element. The movements of the closure parts can thus be coupled.

The connection element may, in the simplest case, be a film hinge. It is, however, also imaginable that the connection element is an extended component having each of the closure parts separately connected thereto, in particular via a film hinge.

The closure device may be configured such that the closing movement is caused by displacing the connection element in a direction of movement parallel to the plane of the closure parts. In this case, the closure parts may define a closure slide together with the connection element. Closing can, in this case, be accomplished so to speak automatically by displacing the connection element. For the operating person, the movement required for closing can therefore correspond to the movement of known slide solutions.

The closure device may in particular be configured such that the closing movement of the closure parts comprises a component perpendicular to the direction of movement of the connection element and a component parallel thereto. As explained above, also the perpendicular component lies here in the plane of the closure parts.

The perpendicular movement components of the closure parts may in particular be directed in opposite directions. In other words, the closure parts can move towards each other during the closure movement.

At an open position of the closure device, at which the closure parts do not overlap with the passage opening, which means that the passage opening is open, the closure parts may be arranged on both sides of the passage opening. Due to the movement components directed towards each other, the closure parts will then also move towards areas that overlap with the passage opening.

At the open position, the closure parts may also be displaced relative to the passage opening in the direction of movement of the connection element. It follows that, due to the combined movement perpendicular and parallel to the direction of movement of the connection element, it can be achieved that the closure parts move towards each other and towards the passage opening, so that, at the closure position, they fully close the passage opening. The closing movement can thus so to speak be a scissor-like movement of the closing parts having superimposed thereon a translational movement.

The closing movement may in particular be a reversible movement. It follows that, if the connection element is moved in a direction opposite to the direction of movement during the closing movement, the closure parts can be moved from the closure position to the open position.

Each of the closure parts may be pivotable about an axis, in particular a common axis. Each of the axes may here be defined by a hinge through which the respective closure part is connected to the connection element. In the case of a common axis, the axis may be defined by the hinge through which the closure parts are interconnected and which, in this case, also defines the connection element. The axis or axes extend here perpendicular to the plane of the closure parts and thus also perpendicular to the plane of the passage opening.

The closure parts may be configured symmetrically to an axis of symmetry, which extends parallel to the direction of movement of the connection element during the closing movement. Also the closing movement may here be a movement symmetrical to the axis of symmetry. The symmetry may in particular be an axial symmetry. This allows a particularly simple structural design of the closure device.

The closure device may especially be configured such that the closing movement is a guided movement of such a nature that the closure parts each comprise a curved guide surface which, during the closing movement, runs along a guide element arranged on the base plate. This guided movement allows the lateral movement of the connection element and thus of the closure parts to be converted into the above described scissor-like, approaching movement.

The curved guide surface may be arranged on a lateral surface of the respective closure part and the guide element may be configured as a respective projection on the base plate. Due to the small dimensions of the closure parts perpendicular to the plane, the guide surface may also be referred to as a guide edge. The curvature of the curved guide surface may be of a continuous nature. The projection on the base plate may especially be a raised portion of the base plate, which is arranged on the base plate side having arranged thereon the closure parts.

Alternatively, the closure device may be configured such that the closing movement is a guided movement of such a nature that the closure parts each comprise a guide element which, during the closing movement, runs along a curved guide surface provided on the base plate. It follows that, in this case, the guide element and the guide surface have been interchanged in comparison with the above described solution.

The curved guide surface may in particular be configured as a groove in the base plate and the guide elements may each be configured as a respective projection on the closure parts engaging the groove. The curved guide surface may in particular correspond to a sidewall of the groove. The groove may especially be configured to surround the passage opening. The groove may, at least sectionwise, be parabolic in shape. The groove may be an oval or an egg-shaped line, which is symmetrical in particular to the axis of symmetry described above. This symmetry may be the only axial symmetry of the groove. In other words, the groove is then neither circular nor elliptical. The curvature of the curved guide surface may be of a continuous nature. The projections on the closure parts may in particular be pins, especially cylindrical pins.

The base plate may have provided thereon stops, so as to prevent the closure parts from moving beyond the closure position and/or an open position. These stops may be in engagement with parts of the closure parts at the closure position and/or the open position, so that they prevent further movement of the closure parts in the closing direction and the opening direction, respectively.

For the closure parts, separate stops may be provided. In addition, the stops for the closure position may be different from those for the open position. The stops may also be part of the above described guide elements, which are arranged on the base plate. For example, the closure device may be configured such that the curved guide surface of the closure parts is delimited by a locking element, which is in engagement with part of the guide element in the closure position, so that a further movement in the same direction will be blocked. A movement in the opposite direction, i.e. in the opening direction, is, however, possible. The same applies to the open position.

In addition, the base plate may comprise a projection and a locking element of a closure part may engage behind this projection at an open position of the closure device. The closure parts can thus be retained at a defined initial position or a defined open position.

This is advantageous for avoiding unintentional closing, e.g. during transport of the retaining plate. The locking element of the closure part may be an above described locking element. The projection of the base plate may, in turn, be part of the above described guide element on the base plate.

Locking elements, projections and/or stops of the type in question may be provided for each of the two closure parts.

The base plate and/or the closure device may each be configured as a thermoformed shaped part. This makes production particularly simple and cost-effective. However, it is also imaginable to configure the base plate and/or the closure device as an injection molded part.

The base plate and/or the closure parts may be made from recycled plastic. In particular, recycled polyethylene terephthalate (rPET) may be used. The base plate and/or the closure parts are then especially made of rPET or contain a very high percentage of rPET, e.g. at least 90% by weight. The rPET may, for example, originate from beverage bottles (bottle flake chips) or metallized PET films. Alternatively or additionally, also recycled polybutylene terephthalate (rPBT), recycled polylactic acid (rPLA), recycled polyglycolide and/or recycled polycaprolactone may be used. Also recycled polyolefins, in particular recycled polypropylene (rPP), recycled polyethylene and/or recycled polystyrene (rPS); recycled polyvinyl chloride (rPVC), recycled polyamides as well as mixtures and combinations thereof are possible.

The closure parts and the closure slide, respectively, as well as the base plate may especially be made from two different plastics. This means that the completely assembled unit consisting of the base plate and the closure parts or closure slide can be welded onto the bag by means of ultrasonic welding through the closure parts or closure slide and the base plate. For this purpose, the complete component is clamped in position between a sonotrode and an anvil and acted upon by ultrasound. In the course of this process, the base plate is welded to the bag material without the closure parts or closure slide being welded to the retaining plate. The plastic material of the base plate may here in particular be incompatible with the plastic material of the closure parts or closure slide. In other words, the plastic material of the base plate is thus essentially prevented from mixing with the plastic material of the closure parts or closure slide, so that these plastic materials will not be welded to one another. By way of example, the closure parts or closure slide may be made of rPP and the retaining plate of rPET.

For many plastic recyclates, relevant international standards exist. The standard relevant for PET plastic recyclates is e.g. DIN EN 15353:2007.

The term "recycled plastic" used for the purposes of the present invention is to be understood as being synonymous with plastic recyclates. As regards the definition of terms, reference is here made to the standard DIN EN 15347:2007.

Recycled plastic is particularly advantageous in the event that the base plate and/or the closure parts are produced by thermoforming.

In the case of injection molding, in particular PP (polypropylene) may be used as a material.

The closure device of the above described retaining plates is thus formed by the closure parts as well as by possible stops, projections, locking elements and connection elements.

The present invention additionally provides a vacuum cleaner filter bag comprising a bag wall and an above described retaining plate connected thereto. The retaining plate may here have one or a plurality of the above mentioned features.

The bag wall may comprise one or a plurality of filter material layers, in particular one or a plurality of layers of nonwovens. Vacuum cleaner filter bags with such a bag wall made of a plurality of filter material layers are known e.g. from EP 2 011 556 or EP 0 960 645. A great variety of plastic materials may be used as a material for the layers of nonwovens, e.g. polypropylene and/or polyester. In particular the bag wall layer which is to be connected to the retaining plate may be a layer of nonwoven.

The bag wall may be provided with a passage opening, the passage opening of the bag wall being especially arranged in alignment with the passage opening of the base plate. The passage opening in the base plate and the passage opening in the bag wall may define an inlet opening through which the air to be cleaned can flow into the interior of the vacuum cleaner filter bag.

The term nonwoven is used in accordance with the definition given in the ISO standard ISO9092:1988 and the CEM standard EN29092, respectively. In particular, the terms fibrous web or fleece and nonwoven are distinguished from one another as described hereinafter in the field of the manufacture of nonwovens, and should also be understood in this way in the context of the present invention. Fibres and/or filaments are used to manufacture a nonwoven. The loose or unattached and still unbonded fibres and/or filaments are referred to as fleece or fibrous web. A so-called fleece binding step turns such a fibrous web into a nonwoven that has sufficient strength for being wound up e.g. into rolls. In other words, a nonwoven has imparted thereto self-supporting characteristics by means of the compaction. (Details on the use of the definitions and/or methods described herein can also be found in the standard work "Vliesstoffe" ("nonwovens"), W. Albrecht, H. Fuchs, W. Kittelmann, Wiley-VCH, 2000.)

The present invention additionally provides a method for producing a retaining plate, in particular an above described retaining plate. The method comprises the following steps:

- providing a base plate having a passage opening formed therein;
- providing a closure device used for closing the passage opening and comprising two closure parts; and
- arranging the closure parts in a plane parallel to the passage opening;
- wherein the base plate is configured as a thermoformed shaped part comprising a middle part and wing sections arranged on two opposed sides of the middle part, the wing sections being connected to the middle part via a folding line or a film hinge; and
- wherein arranging the closure parts comprises folding over the wing sections such that, after folding over of the wing sections, the latter will overlap the closure parts as well as the middle part.

This method allows a particularly easy and therefore cost-effective production of the retaining plate.

When the wing sections have been folded over, they can be connected to the middle part of the retaining plate, e.g. by means of welding. The wing sections are now arranged parallel to the middle part, the closure parts being arranged between the wing sections and the middle part in a common plane. Through the middle part and the folded-up wing sections, a movability of the closure parts perpendicular to the plane of the passage opening will be reduced or avoided completely. In other words, the closure parts can thus be fixed in a direction perpendicular to the passage opening.

The wing sections may have openings of such a nature that, when the wing sections have been folded over, these openings will overlap with the passage opening. In this way, a passage opening, which overlaps with, and is in particular in alignment with the passage opening of the middle part, can also be formed by the folded-up wing sections.

Also the closure device, in particular the closure parts, may be configured as thermoformed shaped parts. It is, however, also possible to configure the closure parts as injection molded parts.

The retaining plate produced in this way may have one or a plurality of the above described features.

Additional features and advantages will be described hereinafter making reference to the exemplary figures, in which FIG. 1 shows a top view of an exemplary retaining plate having the closure parts arranged at an open position;

Figure 1:
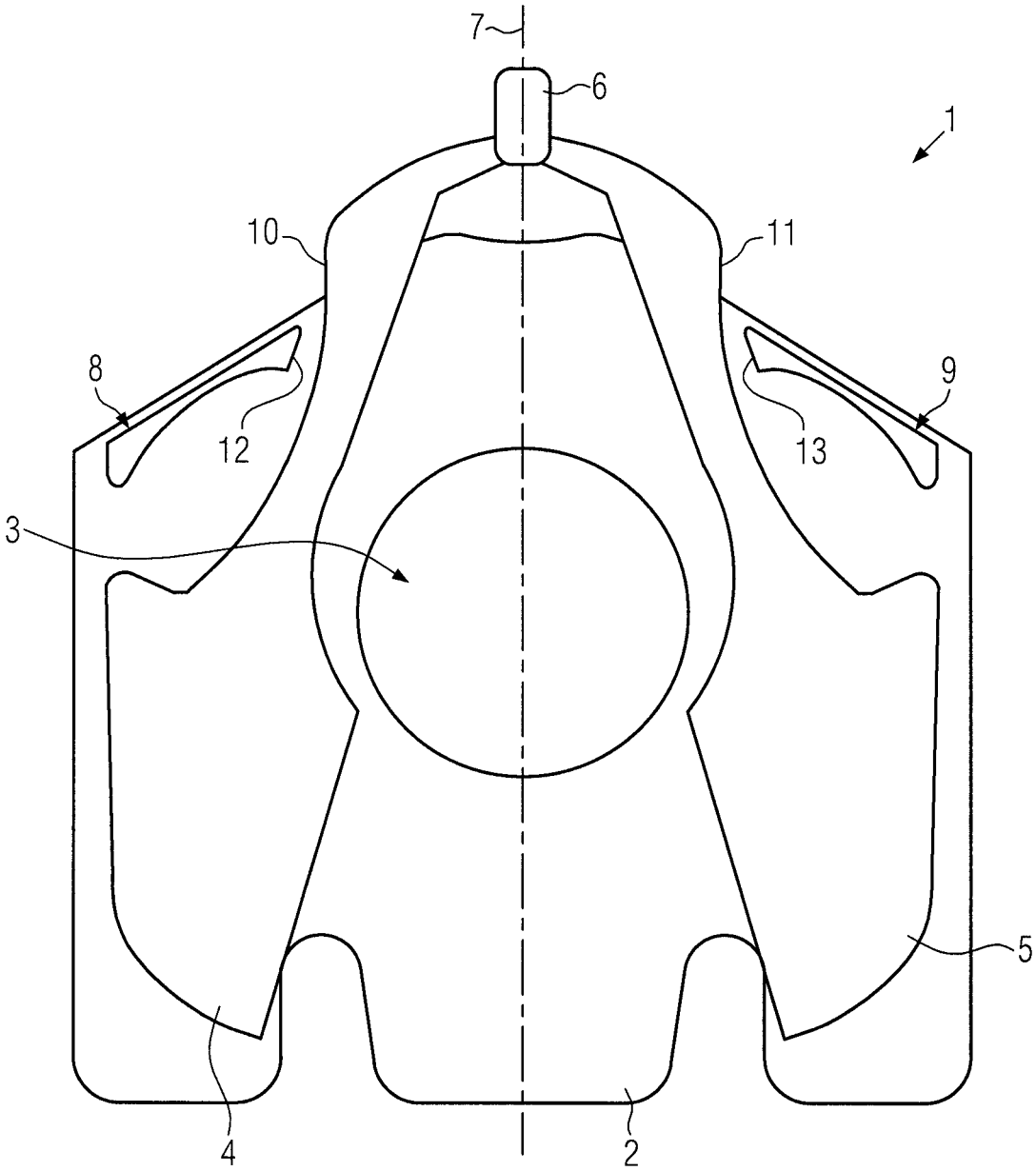

FIG. 1 shows an exemplary retaining plate 1 comprising a base plate 2 having a passage opening 3 formed therein. In addition, two closure parts 4, 5 can be seen, which are interconnected via a connection element 6. The closure parts 4, 5 are arranged in a plane that extends parallel to the passage opening 3 and thus to the base plate 2. The closure parts 4, 5 are shown at an open position, i.e. they do not block the passage opening 3. The closure parts 4, 5 are arranged such that they are laterally displaced relative to the passage opening 3. In the present example, the closure parts 4, 5 are configured symmetrically to the axis 7, which extends parallel to the plane of the passage opening 3. Also the passage opening 3 as well as the base plate 2 are configured symmetrically to the axis of symmetry 7 in the present example.

FIG. 1 also shows two raised portions or projections 8, 9 provided on the base plate 2. As can clearly be seen from the description following hereinafter, the projections 8, 9 have various functions for the closure mechanism.

The closure parts 4, 5 are connected via a film hinge, which is not shown, in the area of the connection element 6. In the simplest case, the film hinge itself may define the connection element. In this case, the connection element is extended even further, whereby the closure device can be handled more easily.

The closure parts are movable relative to each other in the plane in which they are arranged. In particular, they are pivotable about an axis defined by the film hinge, which is not shown. This axis extends perpendicular to the plane of the sheet and thus perpendicular to the plane of the passage opening 3 and to the plane of the closure parts. In addition, a movement of the closure parts 4, 5 in a direction parallel to the axis of symmetry 7 is possible. For closing the passage opening, the connection element 6 can in particular be moved by an operating person in a direction parallel to the axis of symmetry 7 and away from the passage opening 3. As a result, also the closure parts 4, 5 move in this direction until they enter into engagement with the projections 8, 9.

The closure parts 4, 5 each have a curved guide surface 10, 11, which faces the projections 8, 9. When the guide surfaces 10, 11 come into contact with the edges 12, 13 of the projections 8, 9, the movement of the closure parts 4, 5 will be guided such that the curved guide surface will move along the edges 12, 13. Through the curvature of the guide surfaces 10, 11, a movement component of the closure parts 4, 5 perpendicular to the direction of movement of the connection element 6 is generated. In other words, the closure parts 4, 5 are moved towards each other. Simultaneously, the closure parts 4, 5 additionally move translationally with a movement component parallel to the direction of movement of the connection element 6.

Figure 2:
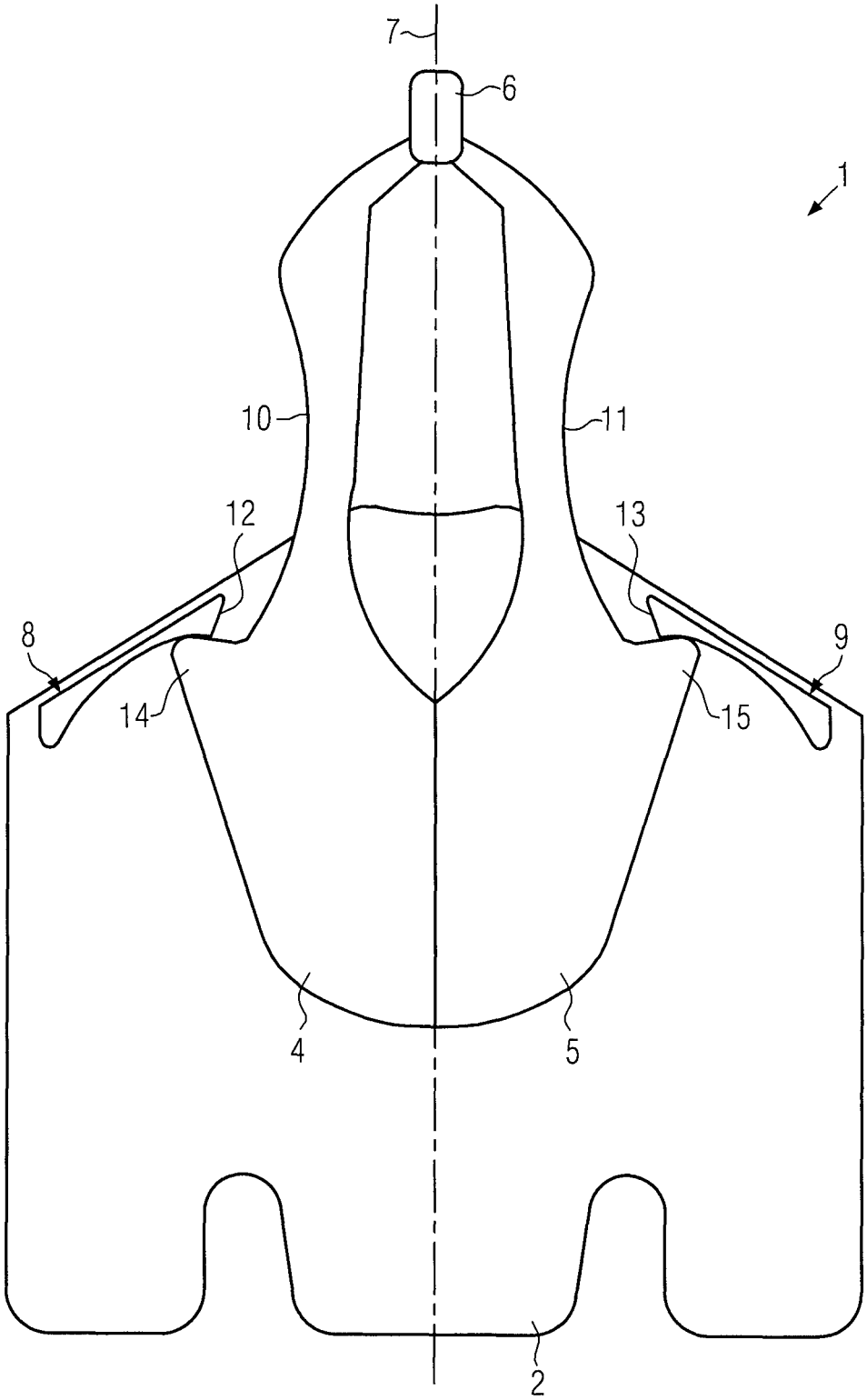
FIG. 2 shows a top view of an exemplary retaining plate having the closure parts arranged at a closure position.

FIG. 2 shows the closure parts 4, 5 at the closure position. At this position, they close the passage opening, which is no longer visible in this figure, by overlapping it when seen from above. In the present case, a respective half of the passage opening 3 is overlapped by a respective one of the closure parts 4, 5.

In order to prevent the closure parts 4, 5 from moving beyond the closure position, parts of the projections 8, 9 define stops with which parts of the closure parts 4, 5 are in engagement at the closure position. In particular, the closure parts 4, 5 have laterally provided thereon projections 14, 15, which cooperate with the projections 8, 9 acting as stops.

Figure 3:
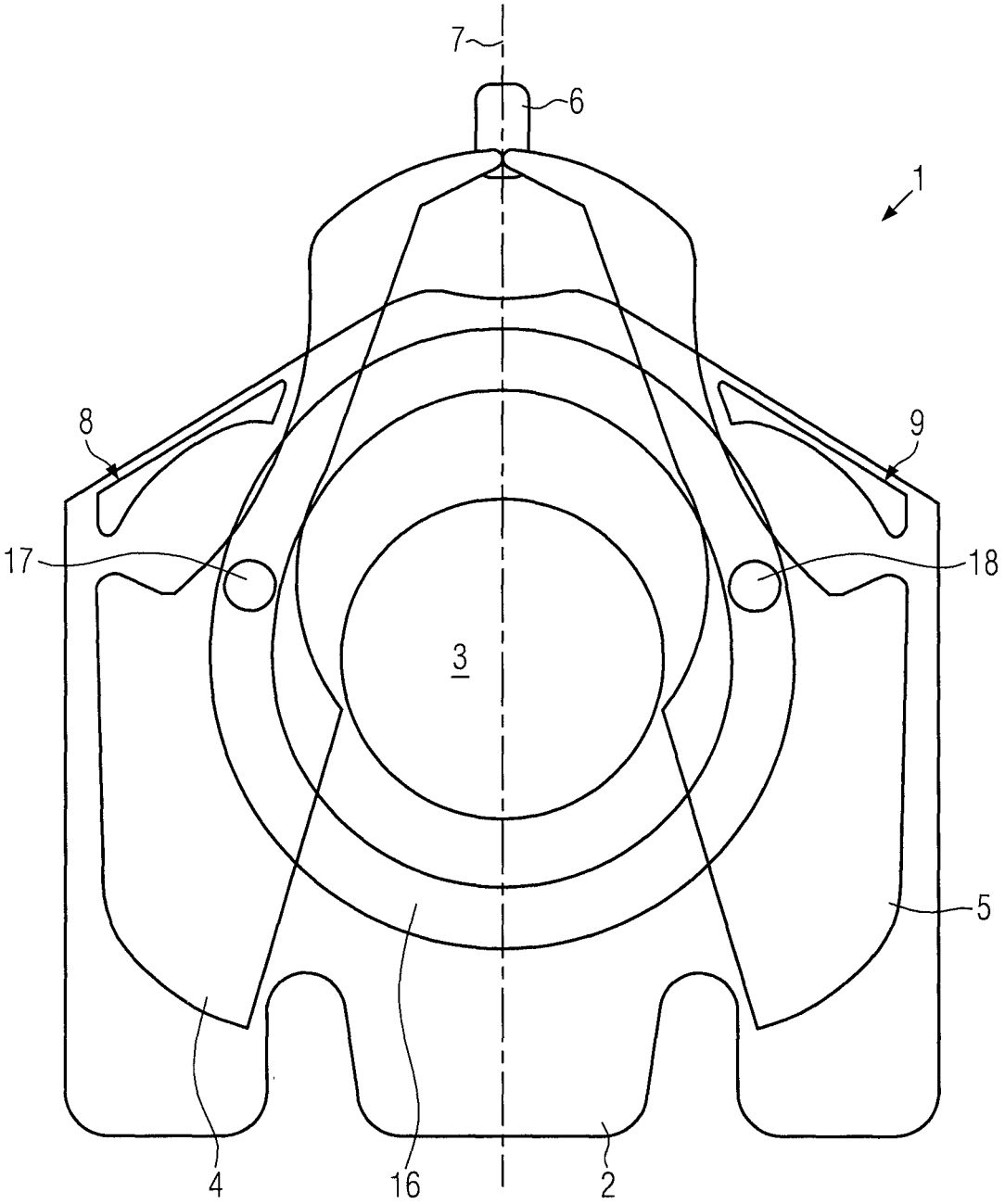
FIG. 3 shows a top view of a further exemplary retaining plate.

FIG. 3 shows a further exemplary retaining plate 1. Just as in the embodiment according to FIGS. 1 and 2, a base plate 2, a passage opening 3 as well as closure parts 4, 5 are provided. The closure parts 4, 5 are again interconnected by a connection element 6. FIG. 3 also shows projections 8, 9. In contrast to the above embodiment, the projections 8, 9 do, however, not have the function of a guide element. Instead, the base plate 2 has provided therein a groove 16 surrounding the passage opening 3. In addition, each of the closure parts 4, 5 comprises a guide element 17, 18 in the form of a projection engaging the groove 16. It follows that the guided closing movement of the closure parts 4, 5 towards each other is, in this example, accomplished by the fact that the projections 17, 18 of the closure parts 4, 5 move along a curved guide surface of the groove 16. The closing movement again results in a combination of a translational movement and a pivoting movement, so that the closure parts can be arranged at the closure position of FIG. 2. At the closure position, the projections 8, 9 again serve as stops for preventing a movement beyond the closure position.

The closing of the passage opening 3 is reversible. The connection element 6 can be moved in a direction of movement parallel to the axis of symmetry 7 and towards the passage opening 3. The closure parts 4, 5 will then move in an opening movement in a direction opposite to the above-described closing movement, until they arrive again at the open position of FIGS. 1 and 3, respectively.

Figure 4:
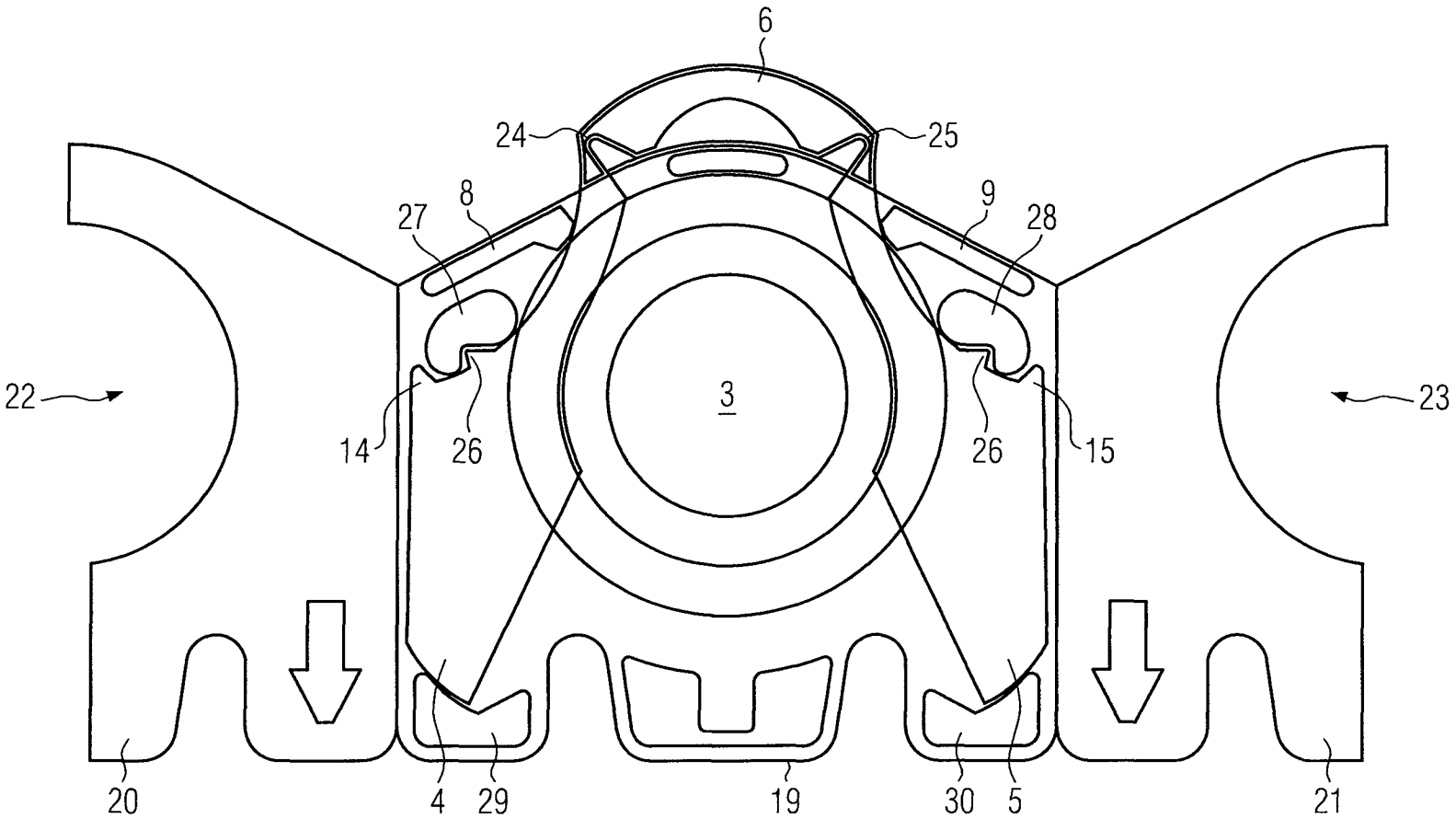
FIG. 4 shows an illustration of an intermediate step of the production process of an exemplary retaining plate.

FIG. 4 illustrates the production of an exemplary retaining plate as well as additional features of an exemplary closure device.

According to an example, the base plate may be configured as a thermoformed shaped part. This allows a particularly cost-efficient production, since no cost-intensive injection molding tool has to be manufactured. In addition, recycled plastic can be used for thermoforming, and this is advantageous from an ecological point of view.

The retaining plate 1, which is shown in FIG. 4 and which has not yet been finished, comprises a base plate configured as a thermoformed part. The base plate comprises a middle part 19 as well as wing sections 20, 21 arranged on opposite sides. The wing sections 20, 21 can each be pivoted about the side of the middle part 19 on which they are arranged. For this purpose, the wing sections 20, 21 may be connected to the middle part 19, e.g. via a film hinge or a folding line.

After the closure parts 4, 5, which are interconnected by a bar-shaped connection element 6 in this example, have been arranged, the wing sections 20, 21 can be folded towards the middle part 19 in such a way that the wing sections 20, 21 will overlap with the middle part 19 as well as with the closure parts 4, 5. The wing sections 20, 21 have openings 22, 23 provided therein, so that the passage opening 3 will not be covered in the overlapped condition of the middle part 19. The folded-over wing sections 20, 21 can then be connected to, e.g. welded to the middle part 19 in order to fix them in their position in a plane parallel to the plane of the passage opening 3. Through the folded-over wing sections 20, 21, also the closure slide, which is defined by the closure parts 4, 5 and the connection element 6, will be fixed in a direction perpendicular to the plane of the passage opening 3. The closure parts 4, 5 can then only be moved in the common plane in which they are arranged and which is arranged parallel to the plane of the passage opening 3.

The closure slide of the embodiment according to FIG. 4 differs slightly from the closure slide according to FIGS. 1 to 3. Firstly, the connection element 6 is bar-shaped and each of the closure parts 4, 5 is connected to the connection element 6 via a separate film hinge 24, 25. In addition, the closure parts 4, 5 each comprise a locking element 26, which, in the depicted open position of the closure parts 4, 5, engages behind a respective projection 27, 28 arranged on the base plate. Due to the fact that the locking element 26 enters into locking engagement with the projection 27, 28, the closure slide cannot easily move away from the open position. The closure parts 4, 5 can thus be fixed or secured in a defined initial position. This can be of advantage in particular for transporting the retaining plate. In this way, it can be guaranteed that the operating person will find a completely open closure slide, when a vacuum cleaner filter bag provided with the retaining plate is to be installed in the vacuum cleaner.

The force acting on the closure slide during the above-described closing movement then causes the locking element 26 to disengage from its engagement with the projections 27, 28, thus allowing the above-described closing movement.

In the example shown, also the projections 14, 15 on the closure parts 4, 5 act as locking elements, which engage behind the projections 27, 28. In this way, additional fixing in the open position can be achieved. It would also be imaginable that the function is achieved by the projections 14, 15 alone and that no separate locking elements 26 are used.

FIG. 4 also shows additional stops 29, 30, which prevent the closure parts 4, 5 from being moved beyond the position shown in FIG. 4.

It follows that the retaining plate described offers a simple, reasonably-priced and spacesaving alternative to known closure solutions. It goes without saying that features specified in the above-describe embodiments are not limited to these special combinations and can also be used in arbitrary other combinations.

The invention claimed is:

1. A retaining plate for a vacuum cleaner filter bag, comprising a base plate having a passage opening formed therein and a closure device for closing the passage opening, wherein the closure device comprises two closure parts arranged in a plane parallel to the passage opening, wherein the closure parts are movable relative to each other in the plane, so that, by a closing movement in the plane, the closure parts are movable to a closure position at which the closure parts close the passage opening by overlapping each a respective part of the passage opening, wherein the closure parts are interconnected via a connection element, wherein the closure device is configured such that the closing movement is caused by displacing the connection element in a direction of movement parallel to the plane of the closure parts, and wherein the closure device is configured such that the closing movement of the closure parts comprises a first movement component perpendicular to the direction of movement of the connection element and a second movement component parallel to the direction of movement of the connection element.

2. The retaining plate according to claim 1, wherein each of the closure parts is pivotable about an axis.

3. The retaining plate according to claim 2, wherein each axis is defined by a hinge through which the respective closure part is connected to the connection element.

4. The retaining plate according to claim 1, wherein the closure parts are configured symmetrically to an axis of symmetry, which extends parallel to the direction of movement of the connection element.

5. The retaining plate according to claim 1, wherein the closure device is configured such that the closing movement is a guided movement, wherein the closure parts each comprise a curved guide surface which, during the closing movement, runs along a guide element arranged on the base plate.

6. The retaining plate according to claim 5, wherein the curved guide surface is arranged on a lateral surface of the respective closure part and the respective guide element is configured as a projection on the base plate.

7. The retaining plate according to claim 1, wherein the closure device is configured such that the closing movement is a guided movement, wherein the closure parts each comprise a guide element which, during the closing movement, runs along a curved guide surface provided on the base plate.

8. The retaining plate according to claim 7, wherein the curved guide surface is configured as a groove in the base plate and the guide elements are each configured as a respective projection on the closure parts engaging the groove.

9. The retaining plate according to claim 1, wherein stops are provided on the base plate to prevent the closure parts from moving beyond the closure position or an open position.

10. The retaining plate according to claim 1, wherein the base plate comprises a projection, and wherein a locking element of a closure part engages behind the projection at an open position of the closure device.

11. The retaining plate according to claim 1, wherein the base plate or the closure device is thermoformed shaped t.

12. The retaining plate according to claim 1, wherein the base plate or the closure parts are made from recycled plastic.

13. A vacuum cleaner filter bag, comprising a bag wall and a retaining plate connected thereto, the retaining plate comprising:

a base plate having a passage opening formed therein and a closure device for closing the passage opening, wherein the closure device comprises two closure parts arranged in a plane parallel to the passage opening, wherein the closure parts are movable relative to each other in the plane, so that, by a closing movement in the plane, the closure parts are movable to a closure position at which the closure parts close the passage opening by overlapping each a respective part of the passage opening, wherein the closure parts are interconnected via a connection element, wherein the closure device is configured such that the closing movement is caused by displacing the connection element in a direction of movement parallel to the plane of the closure parts, and wherein the closure device is configured such that the closing movement of the closure parts comprises a first movement component perpendicular to the direction of movement of the connection element and a second movement component parallel to the direction of movement of the connection element.

14. The retaining plate according to claim 1, wherein each of the closure parts is pivotable about a common axis.

15. The vacuum cleaner filter bag of claim 13, wherein each of the closure parts is pivotable about an axis.

16. The vacuum cleaner filter bag of claim 13, wherein each of the closure parts is pivotable about a common axis.

17. The vacuum cleaner filter bag of claim 13, wherein the closure parts are configured symmetrically to an axis of symmetry, which extends parallel to the direction of movement of the connection element.

18. The vacuum cleaner filter bag of claim 13, wherein the closure device is configured such that the closing movement is a guided movement, wherein the closure parts each comprise a curved guide surface which, during the closing movement, runs along a guide element arranged on the base plate.

19. The vacuum cleaner filter bag of claim 13, wherein the closure device is configured such that the closing movement is a guided movement, wherein the closure parts each comprise a guide element which, during the closing movement, runs along a curved guide surface provided on the base plate.

20. The vacuum cleaner filter bag of claim 13, wherein stops are provided on the base plate to prevent the closure parts from moving beyond the closure position or an open position.

* * * * *